US008330687B2

(12) United States Patent
Jung

(10) Patent No.: US 8,330,687 B2
(45) Date of Patent: Dec. 11, 2012

(54) LIQUID CRYSTAL DISPLAY

(75) Inventor: Herbert Jung, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 699 days.

(21) Appl. No.: 12/318,050

(22) Filed: Dec. 19, 2008

(65) Prior Publication Data

US 2009/0284455 A1 Nov. 19, 2009

(30) Foreign Application Priority Data

May 19, 2008 (KR) ..... 10-2008-0046348

(51) Int. Cl.
*G09G 3/36* (2006.01)

(52) U.S. Cl. ..... 345/87

(58) Field of Classification Search ..... 345/213, 345/699, 87

See application file for complete search history.

(56) References Cited

U.S. PATENT DOCUMENTS

2005/0001792 A1* 1/2005 Watanabe et al. ..... 345/55
2006/0012712 A1* 1/2006 Louie et al. ..... 348/536
2008/0143698 A1* 6/2008 Lee et al. ..... 345/204
2008/0151108 A1* 6/2008 Doswald ..... 348/456

FOREIGN PATENT DOCUMENTS

CN 1407528 4/2003
CN 1979272 6/2007
CN 101046941 10/2007

* cited by examiner

*Primary Examiner* — Alexander S Beck
*Assistant Examiner* — Joseph Pena
(74) *Attorney, Agent, or Firm* — McKenna Long & Aldridge LLP

(57) ABSTRACT

Disclosed herein is a liquid crystal display in which a system board and a timing control board can be used in common in a 60 Hz driving mode and a 120 Hz driving mode without being modified. The liquid crystal display includes a system board for identifying a driving frequency of video data and supplying the video data and control signals at a first driving frequency or second driving frequency as a result of the identification, a timing control board equipped with a timing controller for processing the video data and control signals from the system board, the timing control board supplying the processed video data and control signals at the first or second driving frequency, and a liquid crystal panel for displaying an image based on the video data and control signals supplied from the timing control board.

9 Claims, 5 Drawing Sheets

LIQUID CRYSTAL DISPLAY

This application claims the benefit of the Korean Patent Application No. 10-2008-0046348, filed on May 19, 2008 which is hereby incorporated by reference as if fully set forth herein.

BACKGROUND OF THE INVENTION

1. Field of the Invention

The present invention relates to a liquid crystal display, and more particularly, to a liquid crystal display in which a system board and a timing control board can be used in common in a 60 Hz driving mode and a 120 Hz driving mode without being modified.

2. Discussion of the Related Art

Recently, various flat panel display devices have been developed to reduce weight and volume which are disadvantages of the cathode ray tube. These flat panel display devices may be, for example, a liquid crystal display, a field emission display, a plasma display panel, a light emitting device, and the like.

The liquid crystal display, among the flat panel display devices, is adapted to display an image by adjusting light transmittance of liquid crystal cells depending on a video signal. A liquid crystal display of an active matrix type is advantageous to the display of a moving image in that a switching element is formed for every liquid crystal cell therein. A thin film transistor (TFT) is mainly used as the switching element.

FIG. 1 schematically shows the configuration of a conventional liquid crystal display which is driven at 120 Hz.

Referring to FIG. 1, the conventional liquid crystal display comprises a liquid crystal panel 2 having liquid crystal cells formed respectively in areas defined by n gate lines GL1 to GLn and m data lines DL1 to DLm, a data driver 4 for supplying analog video signals to the data lines DL1 to DLm, a gate driver 6 for supplying scan signals to the gate lines GL1 to GLn, and a timing controller 8 for arranging data red, green and blue (RGB) inputted from an external system board 10 and supplying the arranged data to the data driver 4, and generating a data control signal (DCS) to control the data driver 4 and generating a gate control signal (GCS) to control the gate driver 6.

The liquid crystal panel 2 includes a transistor array substrate and a color filter array substrate bonded to face each other, a spacer for keeping a cell gap between the two array substrates constant, and a liquid crystal filled in a liquid crystal space provided by the spacer (not shown).

The liquid crystal panel 2 further includes thin film transistors (TFTs) formed respectively in the areas defined by the n gate lines GL1 to GLn and the m data lines DL1 to DLm, and liquid crystal cells connected respectively to the TFTs. Each TFT supplies an analog video signal from a corresponding one of the data lines DL1 to DLm to a corresponding one of the liquid crystal cells in response to a scan signal from a corresponding one of the gate lines GL1 to GLn. Each liquid crystal cell can be equivalently expressed as a liquid crystal capacitor Clc because it is provided with a pixel electrode connected to the corresponding TFT, and a common electrode facing the pixel electrode with a liquid crystal interposed therebetween. This liquid crystal cell further includes a storage capacitor Cst connected to the gate line of a previous stage for maintaining an analog video signal charged on the liquid crystal capacitor Clc until a next analog video signal is charged thereon.

The timing controller 8 arranges the data RGB inputted from the external system board 10 for driving the liquid crystal panel 2 and supplies the arranged data to the data driver 4. Also, the timing controller 8 generates the data control signal DCS and the gate control signal GCS using a dot clock DCLK, a data enable signal DE, and horizontal and vertical synchronous signals Hsync and Vsync externally inputted thereto, and applies the generated data control signal DCS and gate control signal GCS to the data driver 4 and gate driver 6, respectively, to control the driving timings thereof.

The gate driver 6 includes a shift register for sequentially generating scan signals, or gate high signals, in response to a gate start pulse GSP and a gate shift clock GSC of the gate control signal GCS from the timing controller 8. This gate driver 6 sequentially supplies the gate high signals to the gate lines GL of the liquid crystal panel 2 to turn on the TFTs connected to the gate lines GL.

The data driver 4 converts the arranged data signals Data from the timing controller 8 into analog video signals in response to the data control signal DCS from the timing controller 8 and supplies analog video signals of one horizontal line to the data lines DL at an interval of one horizontal period in which each scan signal is supplied to each gate line GL. That is, the data driver 4 selects gamma voltages having certain levels based on gray scale values of the data signals Data and supplies the selected gamma voltages to the data lines DL1 to DLm. At this time, the data driver 4 inverts the polarities of the analog video signals to be supplied to the data lines DL1 to DLm in response to a polarity control signal POL.

On the other hand, in order to display a higher-quality image, the liquid crystal display with the above-mentioned configuration must have a higher resolution and a larger size, resulting in an increase in the amount of data to be transmitted. For this reason, a data transmission frequency becomes higher and the number of data transmission lines becomes larger, causing much electromagnetic interference (EMI). In particular, this EMI is mainly generated in digital interfaces between the timing controller of the liquid crystal display and a plurality of data driving integrated circuits (ICs), resulting in the liquid crystal display being unstably driven.

In order to solve the above problem, various data interface methods have recently been adopted for the liquid crystal display to reduce EMI and power consumption in high-speed data transmission. The data interface methods may be, for example, Low-Voltage Differential Signaling (LVDS) using a differential voltage, Mini-LVDS, Reduced Swing Differential Signaling (RSDS), etc.

On the other hand, a comparison will hereinafter be made between interfaces for transmission of data among system boards, timing control boards and liquid crystal panels of liquid crystal displays which are driven at 60 Hz and 120 Hz. The 60 Hz-driven liquid crystal display includes two LVDS ports arranged between the system board and the timing control board, and eight Mini-LVDS ports arranged between the timing control board and the liquid crystal panel. In contrast, the 120 Hz-driven liquid crystal display includes four LVDS ports arranged between the system board and the timing control board, and eight Mini-LVDS ports arranged between the timing control board and the liquid crystal panel.

That is, the amount of data to be processed in the 120 Hz-driven liquid crystal display increases to twice that in the 60 Hz-driven liquid crystal display. As a result, the number of input signal connection pins, a driving method and control signal characteristics are different depending on the respective driving frequencies, which leads to a problem that the type of a timing controller for actual data processing must be different depending on the respective models.

SUMMARY OF THE INVENTION

Accordingly, the present invention is directed to a liquid crystal display that substantially obviates one or more problems due to limitations and disadvantages of the related art.

An advantage of the present invention is to provide a liquid crystal display in which a system board and a timing control board can be used in common in a 60 Hz driving mode and a 120 Hz driving mode without being modified.

Additional features and advantages and of the invention will be set forth in the description which follows, and in part will become apparent from the description or may be learned by practice of the invention. The objectives and other advantages of the invention will be realized and attained by the structure particularly pointed out in the written description and claims hereof as well as the appended drawings.

To achieve these objects and other advantages and in accordance with the purpose of the invention, as embodied and broadly described herein, a liquid crystal display comprises, a system board for identifying a driving frequency of video data and supplying the video data and control signals at a first driving frequency or second driving frequency as a result of the identification; a timing control board including a timing controller for processing the video data and control signals from the system board, the timing control board supplying the processed video data and control signals at the first or second driving frequency; and a liquid crystal panel for displaying an image based on the video data and control signals supplied from the timing control board.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiment(s) of the invention and together with the description serve to explain the principle of the invention.

In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
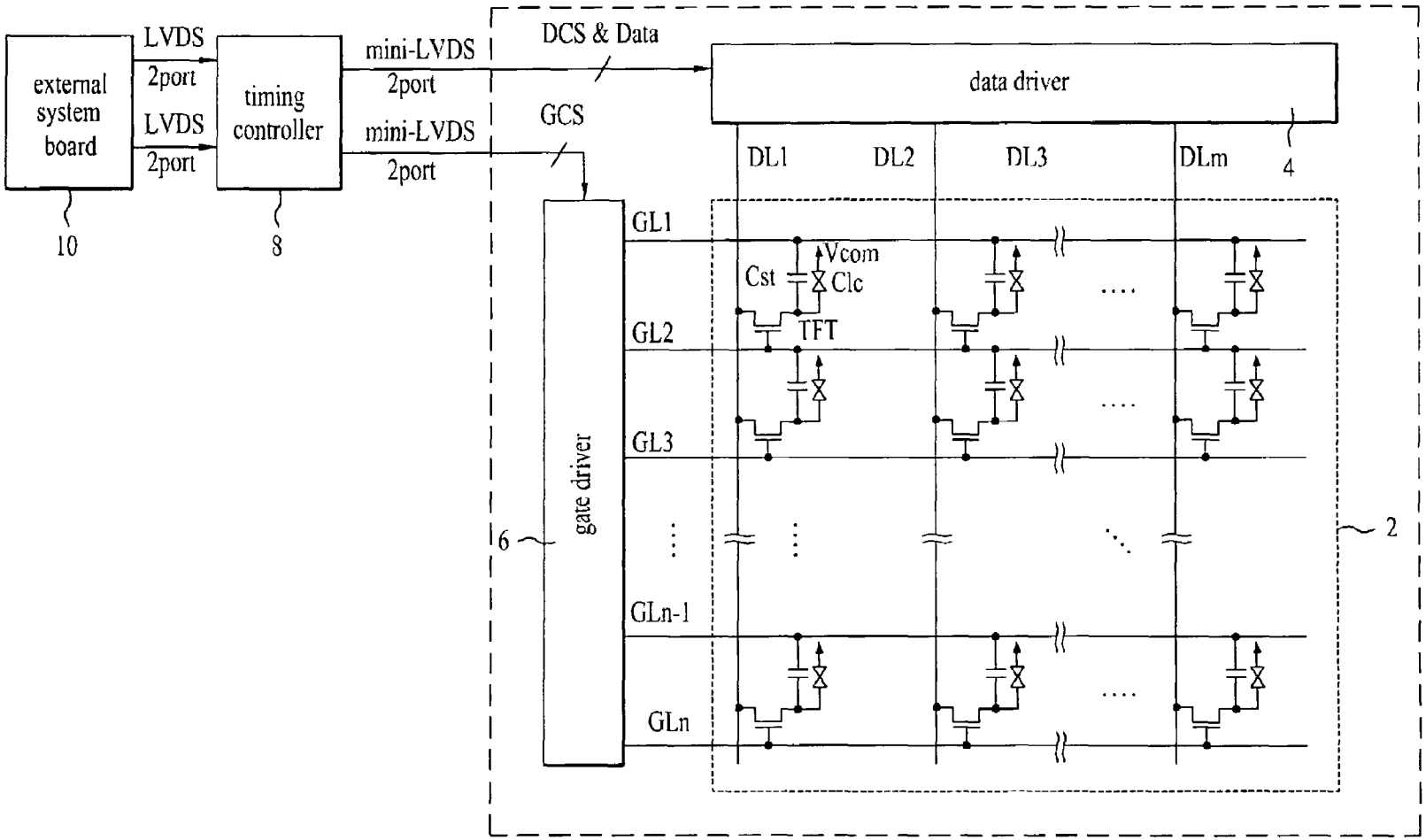
FIG. 1 Related Art.
FIG. 1 is a schematic view of a conventional liquid crystal display which is driven at 120 Hz.
Figure 2:
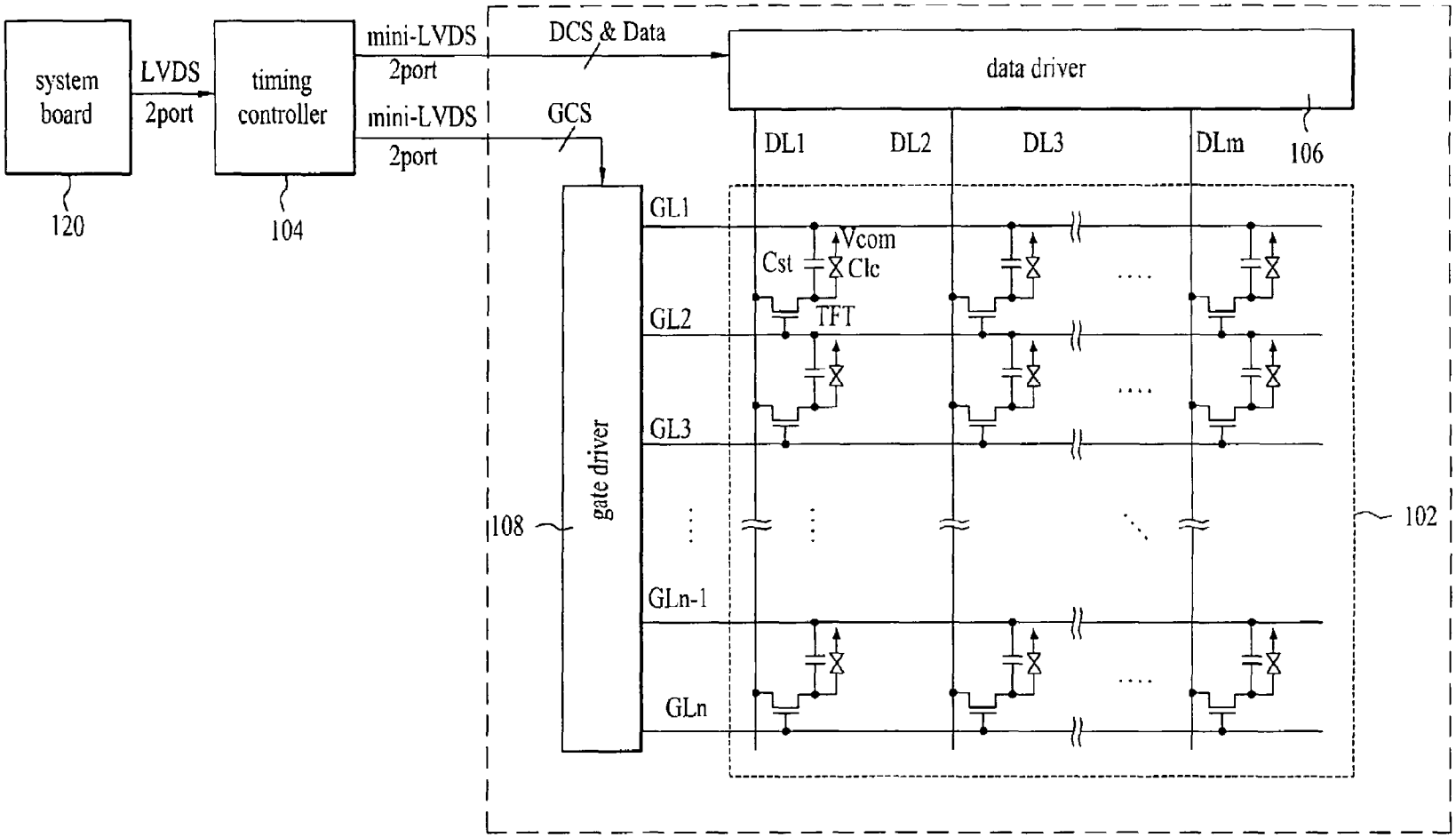
FIG. 2 is a schematic view of a liquid crystal display according to an exemplary embodiment of the present invention.
Figure 3:
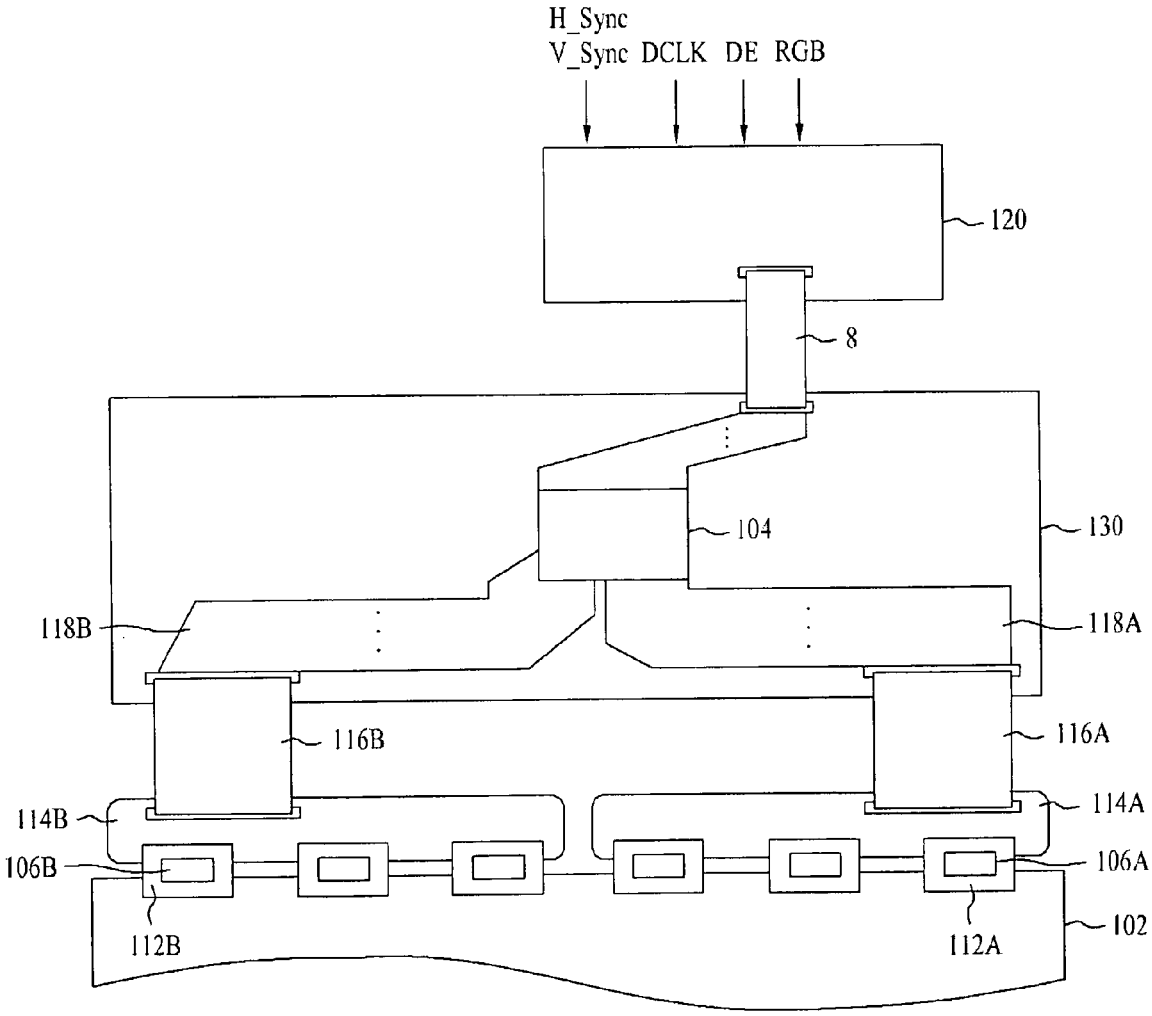
FIG. 3 is a schematic view of the liquid crystal display of FIG. 2.

FIG. 2 is a schematic view of a liquid crystal display according to an exemplary embodiment of the present invention, and FIG. 3 is a schematic view of the liquid crystal display of FIG. 2.

Referring to FIGS. 2 and 3, the liquid crystal display according to the present embodiment comprises a system board 120 for identifying a driving frequency of video data and supplying the video data and control signals at a first driving frequency or second driving frequency as a result of the identification, and a timing control board 130 equipped with a timing controller 104 for processing the video data and control signals from the system board 120. The timing control board 130 is adapted to output the processed video data and control signals at the first or second driving frequency. The liquid crystal display according to the present embodiment further comprises first and second printed circuit boards 114A and 114B for delivering the video data and control signals outputted from the timing control board 130, and a plurality of flexible printed circuit boards 112A and 112B equipped with data driver ICs 106A and 106B, respectively. Each of the data driver ICs 106A and 106B is adapted to process video data and control signals delivered from a corresponding one of the first and second printed circuit boards 114A and 114B such that the delivered video data and control signals can be supplied to a liquid crystal panel 102. The liquid crystal panel 102 is adapted to display an image based on the video data and control signals supplied from the timing control board 130 through the flexible printed circuit boards 112A and 112B.

The liquid crystal panel 102 displays an image based on the video data and control signals supplied from the timing control board 130, and includes a lower substrate and an upper substrate bonded to face each other. Provided between the lower substrate and the upper substrate are a spacer (not shown) for keeping a cell gap between the two substrates constant, and a liquid crystal layer (not shown).

The lower substrate includes a plurality of data lines DL1 to DLm and a plurality of gate lines GL1 to GLn arranged to intersect each other, a plurality of thin film transistors (TFTs) formed respectively in liquid crystal cell areas defined by the intersections of the data lines DL1 to DLm and the gate lines GL1 to GLn, and pixel electrodes of liquid crystal cells Clc connected respectively to the TFTs. Each TFT supplies a video signal from a corresponding one of the data lines DL to a corresponding one of the liquid crystal cells Clc in response to a gate pulse from a corresponding one of the gate lines GL.

Each liquid crystal cell Clc can be equivalently expressed as a liquid crystal capacitor because it is provided with a pixel electrode connected to the corresponding TFT, and a common electrode Vcom facing the pixel electrode with a liquid crystal layer interposed therebetween. This liquid crystal cell further includes a storage capacitor Cst for maintaining a video signal charged on the liquid crystal capacitor until a next video signal is charged thereon.

The upper substrate includes at least three color filters including red, green and blue filters, a black matrix for separating the color filters from one another and defining pixel cells, and a common electrode Vcom to which a common voltage is supplied. Here, the common electrode is formed on the upper substrate in a vertical electric field driving mode such as a Twisted Nematic (TN) mode or Vertical Alignment (VA) mode, and on the lower substrate together with the pixel electrode in a horizontal electric field driving mode such as an In-Plane Switching (IPS) mode or Fringe Field Switching (FFS) mode. Polarizing plates whose optical axes are orthogonal to each other are attached on the upper substrate and lower substrate of the liquid crystal panel 102, respectively. Orientation films for setting of a pre-tilt angle of the liquid crystal are formed on the inner surfaces of the upper substrate and lower substrate contacting the liquid crystal.

The system board 120 receives video data RGB and control signals, such as a dot clock DCLK, a horizontal synchronous signal H_sync, a vertical synchronous signal V_sync and a data enable signal DE, from a driving system such as a personal computer (not shown) which supplies the video data, and transmits the received video data RGB and control signals to the timing control board 130. This system board 120 may employ a Low-Voltage Differential Signaling (LVDS) interface, a Transistor Transistor Logic (TTL) interface, etc. for transmission of the video data and control signals from the driving system.

Figure 4:
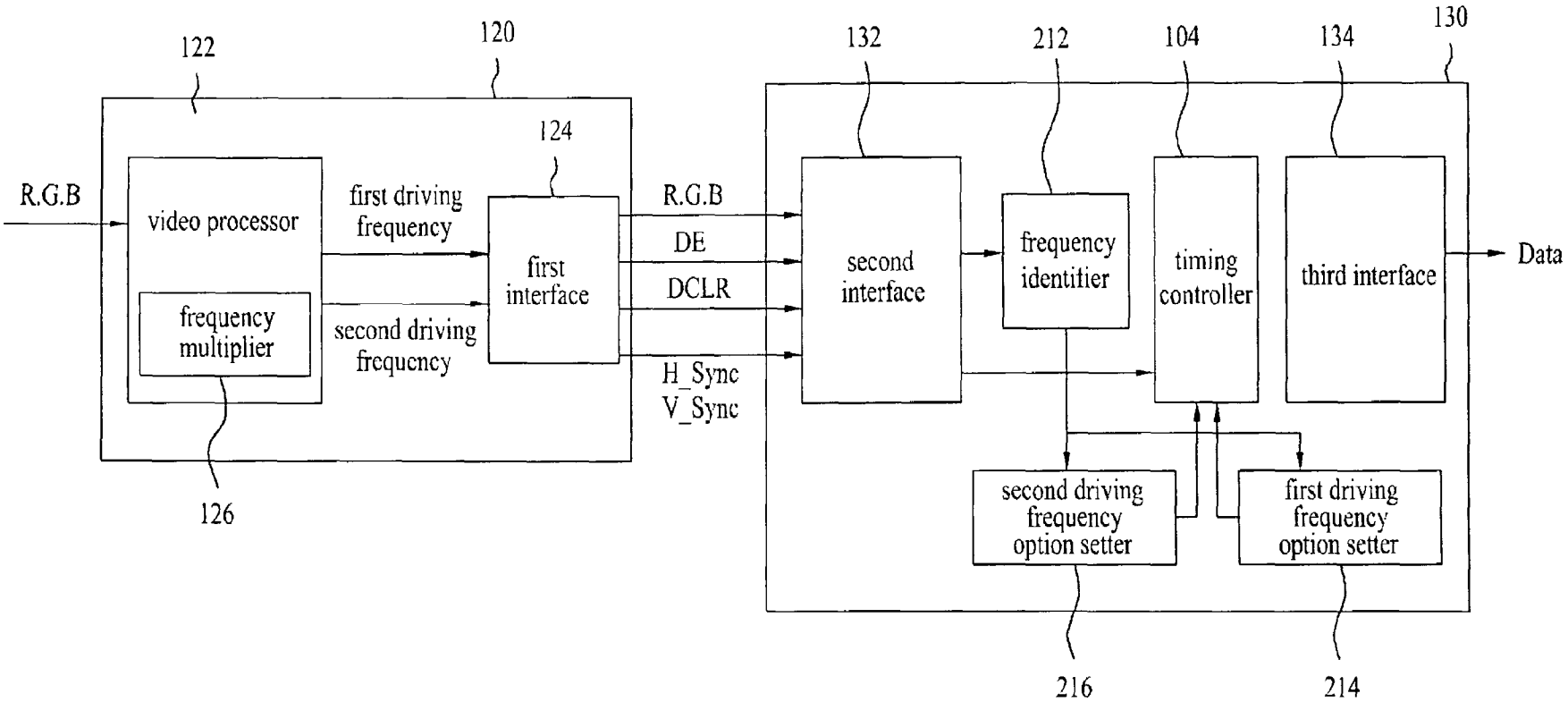
FIG. 4 is a block diagram of a system board and a timing control board according to an exemplary embodiment of the present invention.

The system board 120 includes, as shown in FIG. 4, a video processor 122 for processing the video data RGB and control signals DCLK, DE, V_sync and H_sync externally inputted thereto at the first or second driving frequency, and a first interface 124 for transmitting the video data RGB and control signals DCLK, DE, V_sync and H_sync processed by the video processor 122.

The video processor 122 processes the video data RGB and control signals DCLK, DE, V_sync and H_sync externally inputted thereto and supplies the processed video data and control signals to the first interface 124. Here, the video processor 122 modulates the inputted video data RGB and control signals DCLK, DE, V_sync and H_sync at the first or second driving frequency at which they are to be outputted and transfers the modulated video data and control signals to the first interface 124.

In other words, in the case where the video data RGB and control signals DCLK, DE, V_sync and H_sync are determined to be processed at the first driving frequency and the first driving frequency is 60 Hz, the video processor 122 processes the video data RGB and control signals DCLK, DE, V_sync and H_sync at 60 Hz and supplies the processed video data and control signals to the timing control board 130. In contrast, in the case where the video data RGB and control signals DCLK, DE, V_sync and H_sync are determined to be processed at the second driving frequency and the second driving frequency is 120 Hz, the video processor 122 multiplies the driving frequency of the video data RGB and control signals DCLK, DE, V_sync and H_sync, generally supplied at 60 Hz, by 120 Hz by means of a frequency multiplier 126, processes the video data RGB and control signals DCLK, DE, V_sync and H_sync at 120 Hz and supplies the processed video data and control signals to the timing control board 130.

The frequency multiplier 126 is provided in the video processor 122 to multiply the driving frequency of the inputted video data by the first driving frequency or second driving frequency at which the video data is to be processed and supply the resulting high frequency as the video data driving frequency.

The first interface 124 supplies the video data and control signals processed by the video processor 122 to the timing control board 130. The first interface 124 supplies the video data RGB and control signals DCLK, DE, V_sync and H_sync to the timing control board 130 through two ports at the first or second driving frequency selected by the video processor 122. In other words, the first interface 124 transmits the video data RGB and control signals DCLK, DE, V_sync and H_sync processed at the first or second driving frequency selected by the video processor 122 to the timing control board 130 using an LVDS interface scheme. At this time, a transmission frequency at which the first interface 124 transmits the video data RGB and control signals DCLK, DE, V_sync and H_sync may be set to 74 to 148 MHz.

The timing control board 130 processes the video data RGB and control signals DCLK, DE, V_sync and H_sync supplied from the first interface 124 and supplies the processed video data and control signals to the liquid crystal panel 102. The timing control board 130 includes a second interface 132 for receiving the video data and control signals supplied from the first interface 124, a timing controller 104 for processing the video data and control signals received by the second interface 132, and a third interface 134 for transmitting the video data processed by the timing controller 104.

The timing control board 130 further includes a frequency identifier 212 for identifying the driving frequency of the video data, a first driving frequency option setter 214 for setting and outputting timing control signals and values appropriate to the processing of the video data when the driving frequency identified by the frequency identifier 212 is the first driving frequency, and a second driving frequency option setter 216 for setting and outputting timing control signals and values appropriate to the processing of the video data when the driving frequency identified by the frequency identifier 212 is the second driving frequency.

The second interface 132 receives the video data RGB and control signals DCLK, DE, V_sync and H_sync transmitted from the first interface 124 through two ports. Here, the second interface 132 receives the video data RGB and a control signals, DCLK, DE, V_sync and H_sync transmitted from the first interface 124 and transmits the received video data and control signals to the timing controller 104.

The frequency identifier 212 identifies the driving frequency of the video data supplied from the system board 120 through the second interface 132 to determine whether the driving frequency of the supplied video data is the first or second driving frequency. At this time, the first or second driving frequency may be 60 Hz or 120 Hz.

The first driving frequency option setter 214 provides values set for the processing of the video data supplied from the system board 120 to the timing controller 104 when the driving frequency identified by the frequency identifier 212 is the first driving frequency. The set values from the first driving frequency option setter 214 are stored in the form of a look-up table in the first driving frequency option setter 214 and then supplied to the timing controller 104.

The second driving frequency option setter 216 provides values set for the processing of the video data supplied from the system board 120 to the timing controller 104 when the driving frequency identified by the frequency identifier 212 is the second driving frequency. The set values from the second driving frequency option setter 216 are stored in the form of a look-up table in the second driving frequency option setter 216 and then supplied to the timing controller 104.

The timing controller 104 arranges the video data RGB supplied from the system board 120 into data signals Data suitable for the driving of the liquid crystal panel 102 and supplies the arranged data signals Data to a data driver 106. Also, the timing controller 104 generates a data control signal DCS and a gate control signal GCS using a main clock DCLK, a data enable signal DE, and horizontal and vertical synchronous signals Hsync and Vsync externally inputted thereto, and applies the generated data control signal DCS and gate control signal GCS to the data driver 106 and gate driver 108, respectively, to control the driving timings thereof. Here, the data control signal DCS includes a source start pulse SSP, a source shift clock SSC, and a source output enable signal SOE, and the gate control signal GCS includes a gate start pulse GSP, a gate output enable signal GOE, and a plurality of gate shift clocks GSC.

Here, the gate start pulse GSP indicates a start horizontal line at which the scanning is started in one vertical period in which one frame is displayed. The gate shift clock signal GSC is a timing control signal which is inputted to a shift register in the gate driver to sequentially shift the gate start pulse GSP. This gate shift clock signal GSC has a pulse width corresponding to an ON period of the TFT. The gate output enable signal GOE enables the output of the gate driver 108.

The data control signal DCS includes data timing control signals including the source shift clock SSC, the source output enable signal SOE and a polarity control signal POL. The source shift clock SSC controls a data latch operation of the data driver 106 on the basis of a rising or falling edge thereof. The source output enable signal SOE enables the output of the data driver 106. The polarity control signal POL controls the polarity of a data voltage to be supplied to each liquid crystal cell Clc of the liquid crystal panel 102.

Also, in order to reduce electromagnetic interference (EMI) and a swing width of a data voltage on a data transfer path, the timing controller 104 modulates data in a Mini-Low-Voltage Differential Signaling (LVDS) manner or Reduced Swing Differential Signaling (RSDS) manner and supplies the modulated data to the data driver 106.

The third interface 134 transmits odd pixel data (RGBodd) and even pixel data (RGBeven) of the digital video data supplied from the timing controller 104 to the data driver 106. Here, the third interface 134 transmits the digital video data supplied from the timing controller 104 to the data driver 106 at the first or second driving frequency identified by the frequency identifier 212.

The gate driver 108 sequentially generates and supplies scan pulses, or gate pulses, to the gate lines GL1 to GLn in response to the gate control signal GCS including the gate output enable signal GOE, gate start pulse GSP and gate shift clock signal GSC from the timing controller 104. At this time, a supply voltage Vdd from a power supply is supplied to the gate driver 108. As a result, the gate driver 108 generates a gate high voltage VGH and a gate low voltage VGL using the supply voltage Vdd.

The gate driver 108 includes a shift register, a level shifter for converting a swing width of an output signal from the shift register into that suitable to the driving of the TFT of the liquid crystal cell, and an output buffer connected between the level shifter and the gate lines GL1 to GLn. With this configuration, the gate driver 108 sequentially outputs the scan pulses. Here, the gate driver 108 may be mounted in a Chip-On-Film (COF) or Tape Carrier Package (TCP) and connected to gate pads formed on the lower substrate of the liquid crystal panel 102 via an anisotropic conductive film (ACF).

Alternatively, the gate driver 108 may be directly formed on the lower substrate of the liquid crystal panel 102 using a Gate-In-Panel (GIP) process, simultaneously with the data lines DL1 to DLm, gate lines GL1 to GLn and TFTs formed in a pixel array. As another alternative, the gate driver 108 may be directly adhered on the lower substrate of the liquid crystal panel 102 in a Chip-On-Glass (COG) manner.

The data driver 106 latches the digital video data RGBodd and RGBeven under the control of the timing controller 104. Then, the data driver 106 selects analog positive/negative gamma compensation voltages corresponding to gray scale values of the digital video data based on the polarity control signal POL, converts the digital video data into positive/negative analog data voltages based on the selected analog positive/negative gamma compensation voltages and supplies the converted positive/negative analog data voltages to the data lines DL1 to DLm.

Hereinafter, with reference to FIG. 3, a description will be given of connection relationships among the system board 120, timing control board 130, first and second printed circuit boards 114A and 114B and liquid crystal panel 102 of the liquid crystal display according to the present embodiment.

The data driver ICs 106A and 106B are mounted on the flexible printed circuit boards 112A and 112B, respectively. The flexible printed circuit boards 112A and 112B may be formed of a COF or TCP.

The flexible printed circuit boards 112A and 112B are separately connected to the first and second printed circuit boards 114A and 114B separated from each other. In other words, the flexible printed circuit boards 112A are connected to the first printed circuit board 114A to supply data to data lines formed at the right-hand side of the liquid crystal panel 102, and the flexible printed circuit boards 112B are connected to the second printed circuit board 114B to supply data to data lines formed at the left-hand side of the liquid crystal panel 102. The flexible printed circuit boards 112A and 112B have input terminals electrically connected to output terminals of the first and second printed circuit boards 114A and 114B and output terminals electrically connected to data pads (not shown) formed on the lower substrate of the liquid crystal panel 102 through an ACF. The data pads are connected to the data lines DL1 to DLm via data link lines, not shown.

Formed on the first and second printed circuit boards 114A and 114B are bus lines (not shown) over which the digital video data RGBodd and RGBeven from the timing control board 130 are transmitted, bus lines over which the data timing control signals from the timing control board 130 are transmitted, and bus lines over which the driving voltages from the timing control board 130 are transmitted. The first printed circuit board 114A has input terminals electrically connected to connection lines 118A formed on the timing control board 130 via a first flexible flat cable (FFC) 116A. The second printed circuit board 114B has input terminals electrically connected to connection lines 118B formed on the timing control board 130 via a second FFC 116B.

With this configuration, the first and second printed circuit boards 114A and 114B receive the digital video data RGBodd and RGBeven, data timing control signals and driving voltages from two separate ports, or left and right ports, of the timing controller 104 via the connection lines 118A and 118B formed on the timing control board 130, respectively.

The connection lines 118A and 118B are formed on the timing control board 130 along with the timing controller 104 and circuits including a direct current (DC)-DC converter for generation of the driving voltages of the liquid crystal panel 102. The driving voltages generated by the DC-DC converter include a gate high voltage VGH, a gate low voltage VGL, a common voltage Vcom, a supply voltage Vdd, a ground voltage Vss, and a plurality of gamma reference voltages divided between the supply voltage Vdd and the ground voltage Vss. The gamma reference voltages are subdivided into analog gamma compensation voltages corresponding to respective gray scales in the data driver ICs 106A and 106B. The number of analog gamma compensation voltages corresponds to the number of gray scales expressible by the number of bits of the digital video data RGBodd and RGBeven. The gate high voltage VGH and the gate low voltage VGL are swing voltages of a scan pulse.

Figure 5:
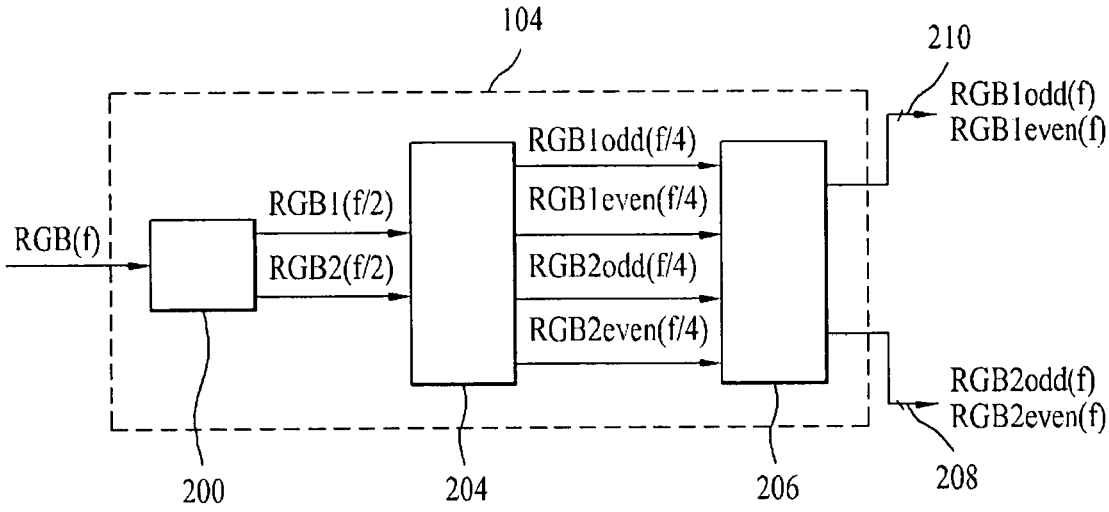
FIG. 5 is a block diagram of a timing controller according to an exemplary embodiment of the present invention.

The connection lines 118A and 118B formed on the timing control board 130 connect two separate ports, or left and right ports, 208 and 210 (FIG. 5) of the timing controller 104 to the FFCs 116A and 116B, respectively. The digital video data RGBodd and RGBeven and timing control signals from the timing controller 104 and the driving voltages from the DC- DC converter are transferred to the FFCs 116A and 116B through the connection lines 118A and 118B. The configuration of the timing controller 104 will hereinafter be described in detail with reference to FIG. 5. The timing controller 104 includes, as shown in FIG. 5, a left/right data separator 200, a 2-port extender 204, and a data modulator 206.

The left/right data separator 200 receives the digital video data RGB from the second interface 132 at a driving frequency f and separates the received digital video data RGB into right data RGB1 and left data RGB2 using a frame memory. The right data RGB1 and left data RGB2 from the left/right data separator 200 are supplied to the 2-port extender 204 at a frequency f/2 of ½ the driving frequency f.

The 2-port extender 204 separates the right data RGB1 and left data RGB2, inputted from the left/right data separator 200 at the ½ frequency f/2, into odd pixel data RGB1odd and RGB2odd and even pixel data RGB1even and RGB2even and supplies the separated data RGBodd and RGBeven to the data modulator 206 at a ¼ frequency f/4.

In the case where the data modulation is performed in a Mini-LVDS manner, the data modulator 206 raises the frequency of the data RGB1odd, RGB2odd, RGB1even and RGB2even supplied from the 2-port extender 204 to the same frequency as the driving frequency f and separately outputs the right data RGB1odd and RGB1even and the left data RGB2odd and RGB2even to the two 19p output ports 208 and 210 through the third interface 134 at the frequency f.

The system board 120 is connected with connection lines 118C connected to input ports of the timing control board 130 using a third FFC 128. As a result, the system board 120 transfers the video data RGB and control signals DCLK, DE, V_sync and H_sync externally inputted thereto to the timing control board 130 through the third FFC 128.

In other words, the right data RGB1odd and RGB1even from the system board 120 are transmitted to the first printed circuit board 114A via the first output port 210 of the timing controller 104, the first connection lines 118A and the first FFC 116A. The left data RGB2odd and RGB2even from the system board 120 are transmitted to the second printed circuit board 114B via the second output port 208 of the timing controller 104, the second connection lines 118B and the second FFC 116B.

As described above, in the liquid crystal display of the present invention, the system board 120 processes the video data RGB externally inputted thereto based on the driving frequency thereof and supplies the processed video data to the timing control board 130, and the timing control board 130 identifies the driving frequency of the supplied video data, processes the video data based on the identified driving frequency and supplies the processed video data to the liquid crystal panel 102. Therefore, the system board 120 and the timing control board 130 can be used in common with respect to any driving frequency without being modified, thereby curtailing a manufacturing cost and improving production efficiency.

As apparent from the above description, in a liquid crystal display according to the present invention, a system board processes video data externally inputted thereto based on a driving frequency thereof and supplies the processed video data to a timing control board, and the timing control board identifies the driving frequency of the supplied video data, processes the video data based on the identified driving frequency and supplies the processed video data to a liquid crystal panel. The system board and the timing control board can be used in common with respect to any driving frequency without being modified. Therefore, it is possible to curtail a manufacturing cost and improve production efficiency.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A liquid crystal display comprising:

a system board for identifying a driving frequency of video data and supplying the video data and control signals at a first driving frequency or second driving frequency as a result of the identification;

a timing control board including a timing controller for processing the video data and control signals from the system board, the timing control board supplying the processed video data and control signals at the first or second driving frequency; and a liquid crystal panel for displaying an image based on the video data and control signals supplied from the timing control board, wherein the system board comprises a video processor for processing the video data and control signals externally input thereto at the first or second driving frequency as the identification result, wherein the video processor modulates the inputted video data and control signals at the first or second driving frequency at which they are to be outputted and transfers the modulated video data and control signals to the first interface, wherein the system board identifies the driving frequency of the video data received by the system board from outside or the driving frequency of the video data to be outputted to the timing control board.

2. The liquid crystal display according to claim 1, wherein the first driving frequency or the second driving frequency is 60 Hz or 120 Hz.

3. The liquid crystal display according to claim 2, wherein the system board further comprises:

a first interface for transmitting the video data and control signals processed by the video processor.

4. The liquid crystal display according to claim 3, wherein the video processor comprises a frequency multiplier for multiplying the driving frequency of the inputted video data by the first driving frequency or the second driving frequency at which the video data is to be processed.

5. The liquid crystal display according to claim 3, wherein the first interface transmits the video data and control signals in a Low-Voltage Differential signaling (LVDS) interface manner.

6. The liquid crystal display according to claim 3, wherein the timing control board comprises:

a second interface for receiving the video data and control signals transmitted from the first interface;

a frequency identifier for identifying the driving frequency of the video data;

a first driving frequency option setter for outputting set values appropriate to the processing of the video data when the driving frequency identified by the frequency identifier is the first driving frequency;

a second driving frequency option setter for outputting set values appropriate to the processing of the video data when the driving frequency identified by the frequency identifier is the second driving frequency;

the timing controller adapted for processing the video data and control signals received by the second interface based on the set values from the first or second driving frequency option setter; and a third interface for transmitting the video data processed by the timing controller.

7. The liquid crystal display according to claim 6, wherein each of the first and the second interfaces comprises two output ports.

8. The liquid crystal display according to claim 6, wherein the third interface comprises arranged respectively at left and right sides thereof.

9. The liquid crystal display according to claim 6, wherein the third interface transmits the video data in a Mini-LVDS manner.

* * * * *